US010689850B2

(12) United States Patent
Langeveld et al.

(10) Patent No.: US 10,689,850 B2
(45) Date of Patent: Jun. 23, 2020

(54) SYSTEM FOR MOUNTING A PLURALITY OF PANELS

(71) Applicant: Hunter Douglas Industries B.V., Rotterdam (NL)

(72) Inventors: Michiel Jacobus Johannes Langeveld, Zoetermeer (NL); John Paulus Alfred Fick, Rijen (NL)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 16/219,037

(22) Filed: Dec. 13, 2018

(65) Prior Publication Data

US 2019/0186134 A1 Jun. 20, 2019

(51) Int. Cl.

| | |
|---|---|
| ***E04B 9/26*** | (2006.01) |
| ***E04B 9/24*** | (2006.01) |
| ***E04B 9/36*** | (2006.01) |
| ***E04F 13/08*** | (2006.01) |
| ***E04F 13/12*** | (2006.01) |
| ***E04B 9/06*** | (2006.01) |

(52) U.S. Cl.

CPC ..... *E04B 9/26* (2013.01); *E04B 9/06* (2013.01); *E04B 9/247* (2013.01); *E04B 9/36* (2013.01); *E04B 9/366* (2013.01); *E04F 13/0803* (2013.01); *E04F 13/083* (2013.01); *E04F 13/0814* (2013.01); *E04F 13/0819* (2013.01); *E04F 13/12* (2013.01); *E04B 9/245* (2013.01)

(58) Field of Classification Search

CPC ..... E04B 9/26; E04B 9/363; E04F 13/0803; E04F 13/0812

See application file for complete search history.

(56) References Cited

U.S. PATENT DOCUMENTS

| | | | | |
|---|---|---|---|---|
| 3,410,043 A * | 11/1968 | Rijnders | E04B 9/363 52/506.08 |
| 4,270,327 A * | 6/1981 | Van Leeuwen | E04B 2/96 52/506.08 |
| 4,309,858 A * | 1/1982 | Anderle | E04B 9/36 52/506.08 |
| 4,328,653 A | 5/1982 | Anderle | |
| 4,441,297 A * | 4/1984 | Rijnders | E04F 13/0803 52/478 |
| 4,646,506 A | 3/1987 | Slapsys | |

(Continued)

FOREIGN PATENT DOCUMENTS

| | | |
|---|---|---|
| AT | 382917 | 4/1987 |
| DE | 2927969 | 2/1981 |

(Continued)

OTHER PUBLICATIONS

European Search Report issued in corresponding Application No. 18211383.7 dated Apr. 18, 2019 (8 pages).

*Primary Examiner* — Brian E Glessner
*Assistant Examiner* — Daniel J Kenny
(74) *Attorney, Agent, or Firm* — Dority & Manning, P.A.

(57) ABSTRACT

A system for mounting plurality of panels includes a carrier part for receiving and supporting the panels at intervals along the length, and a locking strip. The carrier part and the locking strip can be mounted to each other to couple the locking strip relative to the carrier part in a locked position with an elongate edge of the locking strip engaging with the panels.

20 Claims, 15 Drawing Sheets

(56) References Cited

U.S. PATENT DOCUMENTS

| | | | | |
|---|---|---|---|---|
| 4,671,041 | A | 6/1987 | Rijnders | |
| 4,987,715 | A * | 1/1991 | Dunn | E04B 9/26 52/473 |
| 5,590,503 | A * | 1/1997 | Spronken | E04B 9/26 52/677 |
| 6,336,302 | B1 | 1/2002 | Brugman et al. | |
| 6,629,391 | B1 * | 10/2003 | Børresen | E04D 13/031 52/200 |
| 7,293,393 | B2 * | 11/2007 | Kelly | E04B 9/067 52/167.1 |

FOREIGN PATENT DOCUMENTS

| | | |
|---|---|---|
| DE | 9310064 | 9/1993 |
| KR | 101497877 | 3/2015 |

* cited by examiner

Fig 6(a)
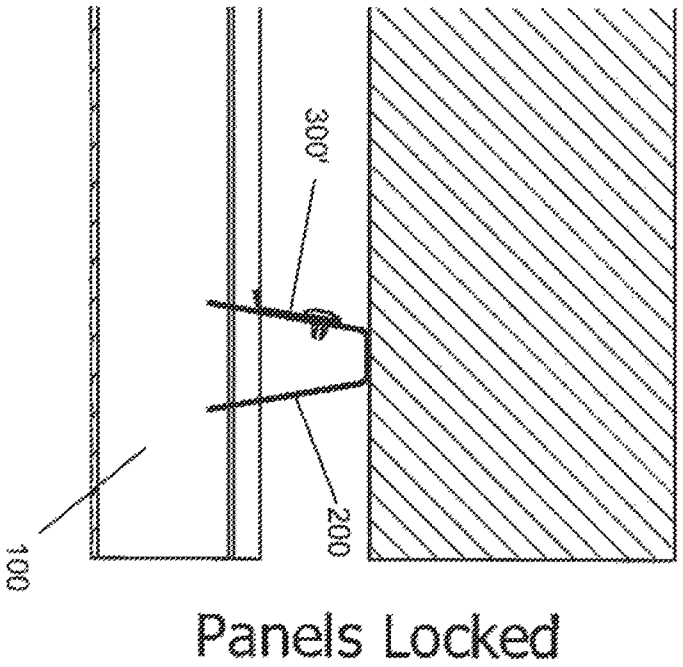
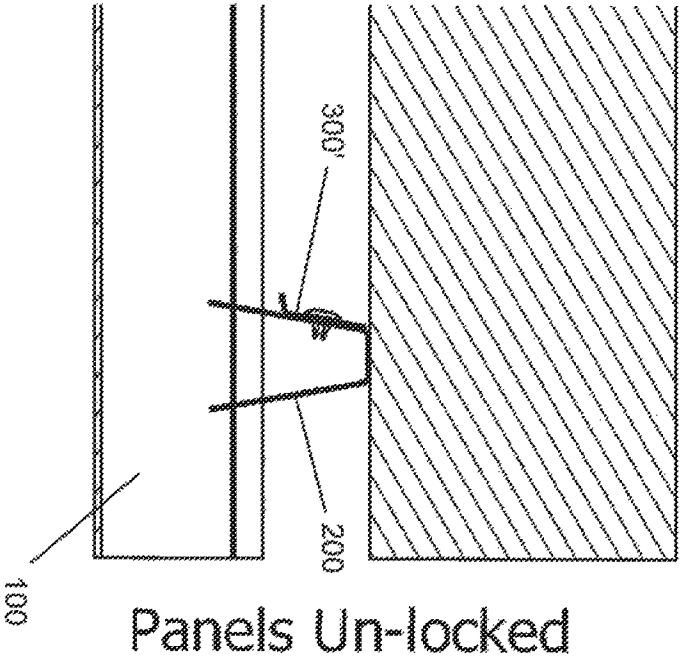
Fig 6(b)

Panels Locked

Panels Un-locked

Panels Un-locked

Panels Locked

SYSTEM FOR MOUNTING A PLURALITY OF PANELS

CROSS-REFERENCE TO RELATED APPLICATIONS

This application is based upon and claims the right of priority to GB Patent Application No. 1720875.2, filed on Dec. 14, 2017, the disclosure of which is hereby incorporated by reference herein in its entirety for all purposes.

BACKGROUND

The following relates to a system for mounting a plurality of panels.

It has been known to suspend, from for example a ceiling, a plurality of panels arranged parallel to one another. The panels are provided with longitudinally and transversally extending lips having support surfaces which, when mounted, face downwardly from the ceiling. The known ceiling mount system is provided with carriers to be mounted to an architectural structure from which components may be hung, such as a ceiling. The plurality of panels are suspended from the carriers in an orientation generally transvers or perpendicular to that of the carriers. In particular, the carriers are provided with protrusions having surfaces for engaging with the lips of the panels so as to support and suspend the panels beneath the ceiling. The known system works well for suspending panels beneath a ceiling. However, where it is desired to mount panels parallel with a surface that is at an angle other than horizontal, more in particular a slanted, angled or vertical surface and especially with the longitudinal extent of the panels oriented vertically, this known carrier system has problems in holding the panels in their desired positions.

SUMMARY

The present application recognises these problems for the first time and aims to provide at least an improved system for mounting panels, in particular where the panels are to be mounted in an at least partial vertical orientation.

It may be desirable to mount a plurality of panels, each panel having a longitudinal extent and a cross-sectional profile that together form a front wall extending between two mutually opposite side walls. The front wall may be considered to be facing in a first relative direction. The side walls include longitudinally and transversely extending respective lips which have support surfaces facing in that first relative direction and are spaced apart from the front wall. For use with such a plurality of panels, there may he provided a system for mounting the panels, the system including a carrier part and a locking strip. The carrier part may have a length and a width and may be configured to receive and support the panels at intervals along said length. The carrier part may have a carrier face extending in the directions of said length and said width and may have, within the extent of said width, for each respective panel, a pair of engaging surfaces facing inwardly with respect to said width for engaging with said support surfaces of the lips of a respective panel. The locking strip may have a length and a width and may have a locking face extending in the directions of said length and said width of the locking strip. The locking strip may have an elongate edge extending along said length of the locking strip. The carrier part and the locking strip may be configured to be mounted to each other with the locking face against a carrier face and may be configured to secure the locking strip relative to the carrier part in a locked position with the elongate edge spaced apart from the pairs of engaging surfaces and pressing on the panels so as to press the support surfaces of the lips of the panels against the respective engaging surfaces.

BRIEF DESCRIPTION OF THE DRAWINGS

Aspects will be more clearly understood from the following description, given by way of example only, with reference to the accompanying drawings, in which:

FIGS. 6(*a*) and (*b*) illustrate the alternative locking strip in use;

DETAILED DESCRIPTION

Figure 1A:
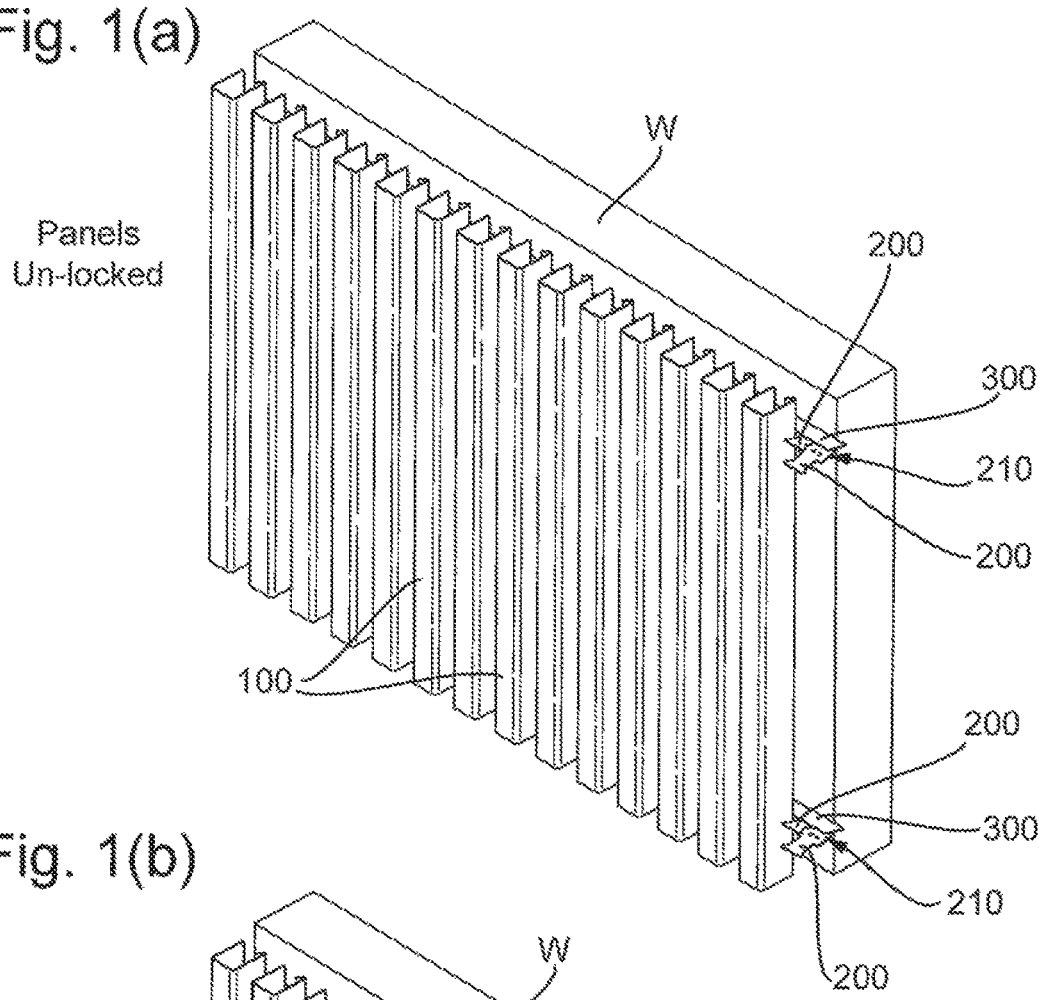
FIGS. 1(*a*) and (*b*) illustrate a mounting system configured in accordance with the present disclosure.

There may be provided a system for mounting a plurality of panels, each panel having a longitudinal extent and a cross-sectional profile that together form a front wall extending between two mutually opposite side walls. The front wall may be considered to be facing in a first relative direction. The side walls include longitudinally and transversely extending respective lips which have support surfaces facing the first relative direction and are spaced apart from the front wall. For use with such a plurality of panels, there may be provided a system for mounting the panels, the system including a carrier part and a locking strip. The carrier part may have a length and a width and may be configured to receive and support the panels at intervals along said length. The carrier part may have a carrier face extending in the directions of said length and said width and may have, within the extent of said width, for each respective panel, a pair of engaging surfaces facing inwardly with respect to said width for engaging with said support surfaces of the lips of a respective panel. The locking strip may have a length and a width and may have a locking face extending in the directions of said length and said width of the locking strip. The locking strip may have an elongate edge extending along said length of the locking strip. The carrier part and the locking strip may be configured to be mounted to each other with the locking face against a carrier face and may be configured to couple the locking strip relative to the carrier part in a locked position with the elongate edge spaced apart from the pairs of engaging surfaces and pressing on the panels so as to press the support surfaces of the lips of the panels against the respective engaging surfaces.

In this way, unlike previous systems for mounting panels, the lips of the panels are not merely supported on the engaging surfaces of the carrier part, but are held with respect to, for example pressed, by means of the locking strip, against those engaging surfaces. As a result, there will be a frictional force and resistance to movement between the lips of the panels and the engaging surfaces of the carriers even when the longitudinal extent of the panels is orientated vertically. Thus, in one embodiment, the panels are held, preferably securely, with respect to the carriers. Of course, this arrangement also provides for a frictional force and resistance against relative movement between the elongate edge of the locking strip and the location at which the elongate edge presses on the panels. Similarly, this helps inhibit and, in some cases, prevent relative movement between the panels and the carriers so as to secure the panels in place.

It is possible to provide carrier parts specifically intended for use with corresponding locking strips. It is also possible to provide a carrier part previously intended for suspension from a ceiling, but, when installed together with the locking strip, available for mounting to an at least partially vertically extending wall.

Often panels can be constructed from a material having some elasticity or plasticity, eg being compressible or deformable. For example, panels may be formed from or coated in a fibre product, such as pressed fibre products or for example a felt material. With such panels, the engaging surfaces of the carrier parts (and the elongate edges of the locking strips) ay press into and/or partially deform surfaces of the panels so that relative movement between the panels and the carrier parts/locking strip is resisted not only by friction but also by the physically deformed shape of the panels' surfaces. Where panels of a less flexible, and perhaps heavier, construction are used, parts of the system, for instance the elongate edge of the locking strip, may be provided with a coating, such as a rubber strip, for increasing the frictional interaction between the carrier parts/locking strips and the panels. Such materials may, for instance be metals, such as steel or aluminium.

Systems may be provided for use with panels having lips which extend inwardly or outwardly with respect to the panel and the side walls.

A system may he provided for use with panels having pairs of lips which extend outwardly from each other. In particular, the cross-sectional profile of the panels having the front wall and two mutually opposite side walls takes the form of a channel-section with the lips extending outwardly from the channels, With such panels, the pairs of engaging surfaces of the carrier part may be provided on respective pairs of protrusions extending towards each other and to be provided outside the two mutually opposite side walls of a respective panel.

A system may be provided for use with panels having pairs of lips which extend inwardly towards each other. Such panels have a neat appearance and a compact cross-section which is relatively easy for transport and storage. In particular, the cross-sectional profile of the panels having the front wall and two mutually opposite side walls takes the form of a channel-section with the lips extending inwardly into the channels. With such panels, the pairs of engaging surfaces of the carrier part may be provided on respective pairs of protrusions extending away from each other and to be provided between the two mutually opposite side walls of a respective panel.

The carrier part may include first and second edges at opposite sides of the width of the carrier part and may define a plurality of channels extending inwardly from the first edge. The plurality of channels may he configured to receive at least a portion of the side walls of the panels and may define the respective pairs of engaging surfaces for the respective panels.

In this way, the carrier part may have a generally planar form constructed as a sheet material. The pairs of engaging surfaces may then be formed, as described above, from channels extending from an edge of the carrier part, although other configurations are within the scope of the disclosure. In many arrangements, an individual respective one of the plurality of channels engages and/or supports, receives a respective side wall of a panel and defines a respective engaging surface. Hence, such channels may be provided in pairs, each pair receiving the two mutually opposite side walls of a respective panel and including the respective pair of engaging surfaces for the respective panel.

The system may include a carrier having at least two of the carrier parts, with the two carrier parts positioned parallel to each other. The two carrier parts have corresponding respective pairs of engaging surfaces for engaging with the same respective lips of respective panels at different positions along the longitudinal extent of the respective panels. The two carrier parts may join with each other at the respective second edges. In this respect, the two carrier parts may join directly with each other at the respective second edges to form a V-shaped profile between the two carrier parts. However, arrangements are possible where the two carrier parts join with each other at the respective second edges by means of an interposed connecting part so as to form a rounded or cornered U-shaped profile. The joining section may be used for mounting/attaching the carrier relative to an architectural surface, such as a wall.

Arrangements to be described below provide interaction between the locking strip and the carrier part so that the locking strip is held in the locked position. It is possible to provide the system with at least one fastener for securing the locking strip to the carrier part in the locked position. During installation, the user locates the plurality of panels with the respective lips adjacent the respective pairs of engaging surfaces of the carrier part, positions the locking strip so as to engage, hold or press against the panels in the locked position, and then uses the at least one fastener to secure the locking strip with respect to the carrier part in that locked position.

In alternative arrangements, the system may include a mounting arrangement configured to mount the locking strip to the carrier part. In one embodiment, the mounting arrangement, although mounting the locking strip to the carrier part, allows movement of the locking strip relative to the carrier part. In particular, the locking strip is movable relative to the carrier part between an unlocked position and the locked position. The mounting arrangement mounts the locking strip to the carrier part so as to provide and allow for that movement between the unlocked and locked positions.

In one arrangement, the mounting arrangement may be configured to provide for and allow linear movement of the locking strip relative to the carrier part.

The mounting arrangement may be configured to allow movement of the locking strip relative to the carrier part at least in the direction of the width of the carrier part.

In this way, from the unlocked position, the locking strip may be moved relative to the carrier part such as in the direction of the width of the carrier part, to the locked position in which the elongate edge of the locking strip engages, holds or presses on the panels.

It is possible for the mounting arrangement to provide for relative movement only in the direction of the width of the carrier part. The mounting arrangement may be configured to constrain movement of the locking strip to only the direction of the width of the carrier part. In this way, during installation, the locking strip is merely moved across the width of the carrier part to the locked position in which the elongate edge engages, holds or presses on the panels.

The locking strip and the carrier part may include respective features for guiding and constraining the relative movement between the locking strip and the carrier part. In this respect, in one embodiment, the mounting arrangement may include, on one of the carrier part and the locking strip, a pin, and, through the other of the carrier part and the locking strip, a through hole. The through hole has an elongate extent in the other of the carrier part and the locking strip having a shape and path according to the required relative movement between the locking strip and the carrier part. The elongate extent extends at least across the width of the other of the carrier part and the locking strip. In this way, the locking strip is able to move from the unlocked position in the direction of the width of the carrier part to the locked position.

Where the mounting arrangement is configured to constrain movement of the locking strip to only the direction of the width of the carrier part, the elongate extent is only across the width of the other of the carrier part and the locking strip.

For arrangements where the mounting arrangement is configured to constrain movement of the locking strip to only the direction of the width of the carrier part, the mounting arrangement may further include a locking part for securing the locking strip relative to the carrier part when the locking strip is in the locked position.

The locking part may include respective apertures through the locking strip and carrier part and a fastener to be positioned through the apertures so as to inhibit or prevent relative movement between the locking strip and the carrier part.

In this way, during installation, the locking strip is moved widthwise across the carrier part to the locked position and then the fastener is positioned through the apertures so as to inhibit or prevent relative movement and/or to hold the locking strip in the locked position.

Alternatively, the locking part includes at least a recess (ie a recess and/or other features) in one of the carrier face and the locking face and a protrusion extending from the other of the carrier face and the locking face. The protrusion is configured to engage in the at least a recess. In this way, the protrusion and the at least a recess may interact so as to prevent relative movement between the locking strip and carrier part. In other words, they may operate for example as a detent arrangement.

The elongate extent can extend not only across the width of said other of the carrier part and locking strip, but also along the length of the other of the carrier part and the locking strip. Thus, movement of the locking strip relative to the carrier part in the direction of the length of the carrier part causes, by the pin following the elongate path, movement of the locking strip relative to the carrier part in the direction of the width of the carrier part between the unlocked and locked positions.

Thus, during installation, the locking strip may be moved, such as in a sliding manner, in the elongate direction of the carrier part along the length direction of the carrier part and, thereby, moved from the unlocked position to the locking position, and, if necessary, from the locked position back to the unlocked position.

It is possible to provide many different shapes for the path of the elongate extent so as to create different relationships between relative movement in the direction of the length and movement in the direction of the width.

The path may be provided with a first end portion for receiving, in one embodiment, the pin when the locking strip is in the locked position. This end portion may extend parallel with the length of the other of the carrier part and the locking strip. Alternatively, the end portion may extend across the width of the other of the carrier part and the locking strip in an opposite direction such that movement of the locking strip relative to the carrier part in said direction of the length of the carrier part causes, by the pin following the elongate path, movement of the locking strip relative to the carrier part in the opposite direction of the width of the carrier part. Thus, considering the main diagonal extent of the elongate path from the unlocked to locked position, the end portion has a different diagonal extent which is in the same length direction, but Opposite width direction.

In this way, in this configuration, when the pin is in the first end portion, there is either no relative widthwise movement between the locking strip and the carrier part when the locking strip is moved lengthwise to the carrier part or the relative widthwise movement acts to press the locking strip against the carrier part. Thus, the locking strip is held in the locked position despite the opposing pressure of the panels pressing the locking strip in the direction of the width of the carrier part. It is not necessary to provide any other means for locking the locking strip in the locked position.

The path may include a second end portion (at an opposite end to the first end portion) for, in one embodiment, receiving the pin when the locking strip is in the unlocked position. The opposite end portion may extend parallel with the length of the other of the carrier part and the locking strip.

In this way, similar to above, the locking strip is held in the unlocked position until it is moved sufficiently in the length direction of the carrier part so as to travel to the locked position.

The path extends between the first end portion and the opposite second end portion. It may extend only in the direction of the width of the other of the carrier part of the locking strip. With such an arrangement, during installation, the locking strip is pushed widthwise to the locked position and then moved lengthwise so that the pin is received in the end portion of the path and the locking strip is secured in the locked position. Alternatively, the path may extend diagonally across at least part of the width of the other of the carrier part and the locking strip. In this way, during installation, the locking strip is moved in a lengthwise direction relative to the carrier part and interaction of the pin received in the path guides the locking strip in a widthwise direction relative to the carrier part to the opposite end portion and the locked position.

The path of the elongate extent described above may include straight/discrete sections and/or curved/continuous sections.

Although as noted above, a pin may be provided on either of the carrier part and the locking strip, it may be preferable in some arrangements to provide a pin on the carrier part and the through hole having an elongated extent in the locking strip. In some arrangements, the carrier part may already include a plurality of apertures in an array extending along the length of the carrier part. It is possible to use respective ones of these apertures to mount and secure the required pins to the carrier part.

The system may be provided with a locking strip having an elongate section extending away from the plane of the locking face to the elongate edge. This elongate section provides additional structural rigidity to the elongate strip and results in the elongate edge contacting panels at an acute angle so that the panels may be held in place more securely. The elongate section may be constructed/formed by bending a plate material forming the locking strip along an elongate line parallel with the elongate edge.

The system may be provided with locking strips having respective ends which are slanted. By slanting the ends of the locking strips with an angle corresponding to the angle of the elongate extent of the path of the through hole for guiding the locking strip relative to the carrier part, locking strips can be mounted next to each other and operated to be locked/unlocked independently.

An array of slots, for example extending substantially across the width of the locking strip, may be provided along the length of the locking strip as an elongate array. These may allow a user conveniently to insert a tool, such as a screwdriver, into a slot so as to adjust the position of the locking strip.

A bending feature may be provided towards the end of a locking strip allowing an end part of the locking strip to be bent into the form of a flange. This resulting flange may provide the user with a convenient feature for gripping and adjusting the position of the locking strip. The bending feature may take the form of a slot extending widthwise across the width of the locking strip and through its thickness.

Rather than provide linear relative movement between the locking strip and the carrier part, it is also possible to provide rotational relative movement between the unlocked and locked positions.

At an edge of the locking strip opposite to the elongate edge which is used to engage, hold or press on the panels, there may be provided a pivot which mounts the locking strip to the carrier part. The pivot has a rotational axis parallel with the elongate edge and allows the locking strip to pivot about said pivot between the unlocked position and the locked position.

In the unlocked position, the locking strip will be pivoted with the locking face away from the carrier face of the carrier part. During installation, the locking strip is pivoted about the rotational axis of the pivot so that the locking face is brought to a position against the carrier face and the locking strip is in the locked position with the elongate edge of the locking strip pressing on the panels.

Although it is possible to provide pivots including hinges with pins, the pivot may include a bent portion protruding through a recess. The bent portion may be provided in one of the locking strip and the carrier part and the recess may be provided in the other of the locking strip and the carrier part. In the unlocked position with the locking face of the locking strip rotated away from the carrier face of the carrier part, it might be possible to separate the locking strip from the carrier part merely by withdrawing the bent portion from the recess. However, as the locking strip is rotated into the locked position, the bent portion further engages in the recess so as to retain the locking strip securely to the carrier part in the locked position.

Figure 1B:
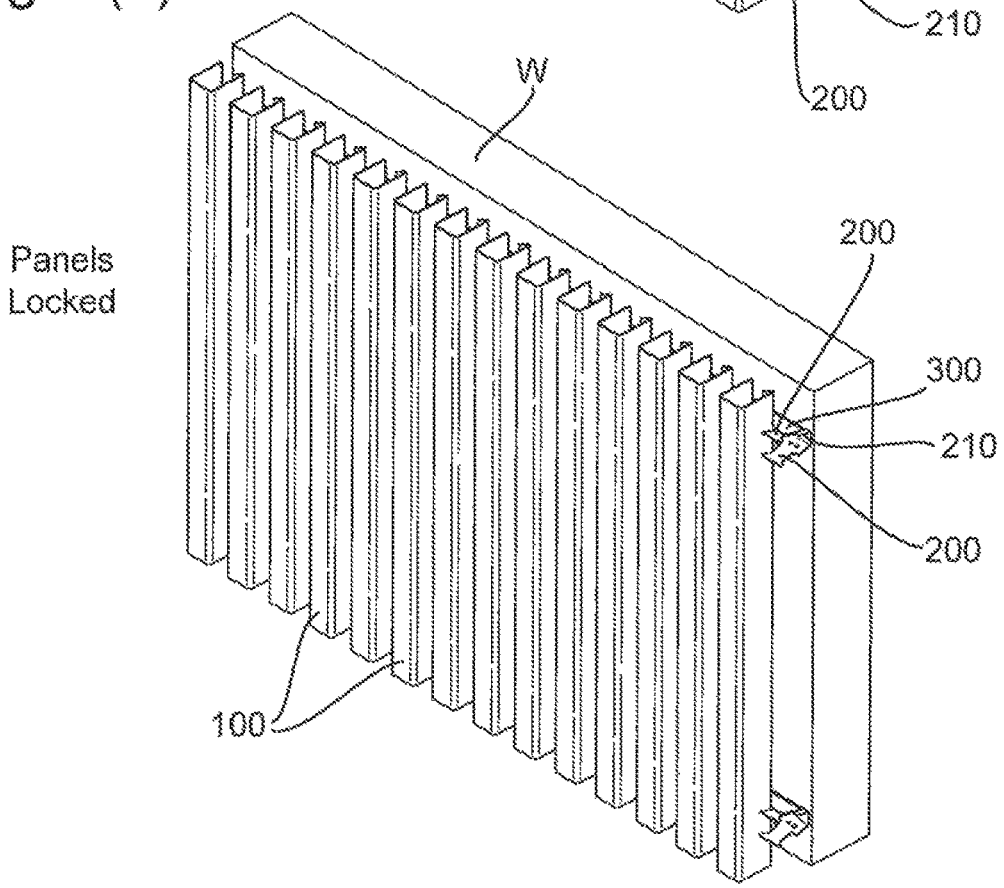

FIGS. 1(*a*) and (*b*) illustrate a system for mounting a plurality of panels 100 to an architectural structure or surface, such as a wall W. As explained above, the system is advantageous in more securely mounting panels in an at least partially vertical orientation. However, it can, of course, also be used in horizontal orientations.

FIG. 1(*a*) illustrates the system in an unlocked state and FIG. 1(*b*) illustrates it in a locked state.

The system includes a plurality of carrier parts 200, each for receiving and supporting the panels 100. The system also includes locking strips 300 for use with the carrier parts 200.

In the illustrated arrangement, the carrier parts are provided in pairs, as part of a carrier 210. However, it will be appreciated that carrier parts 200 may be provided individually.

Figure 2:
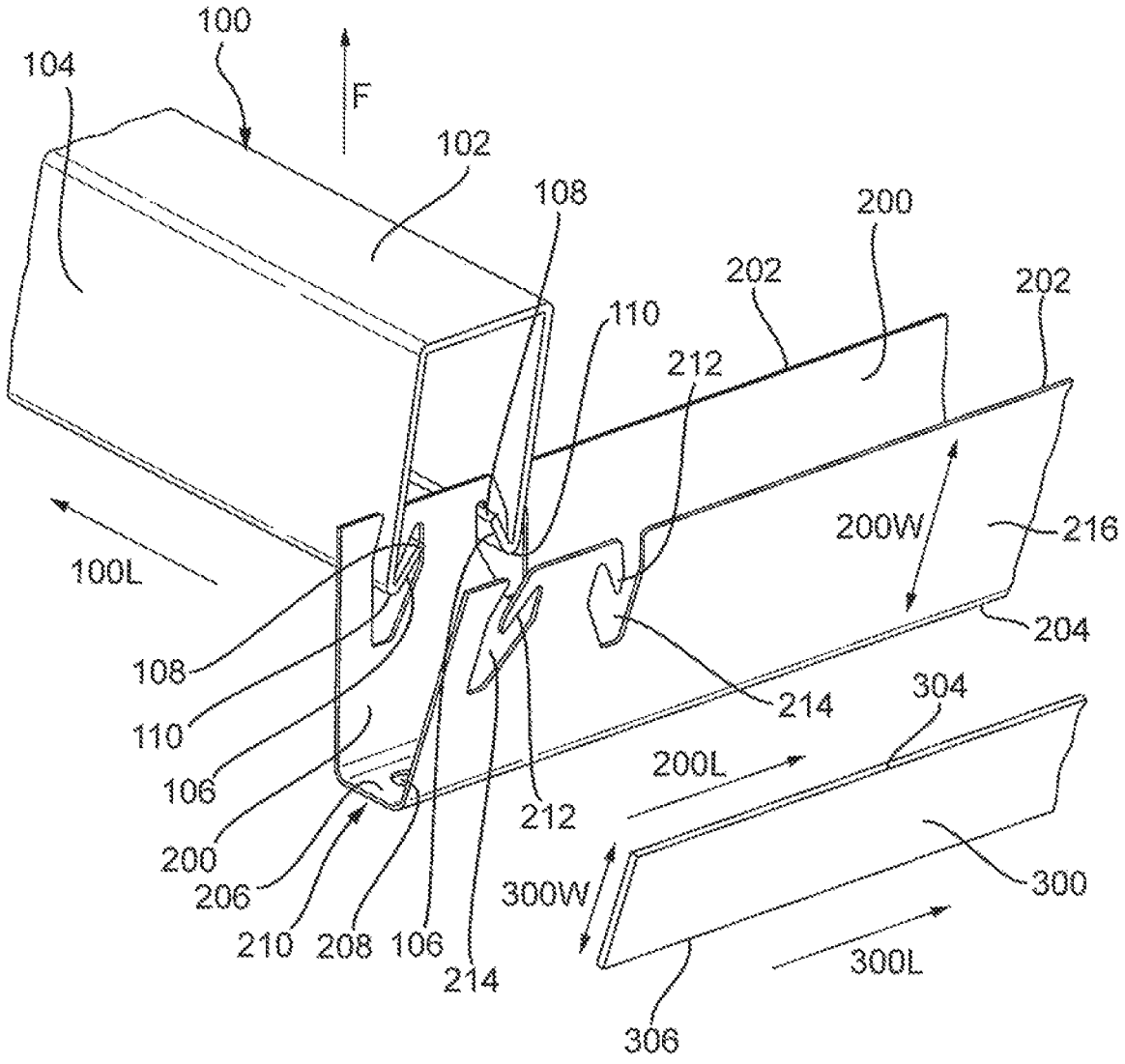
FIG. 2 illustrates schematically a carrier and locking strip of the mounting system.
Figure 3:
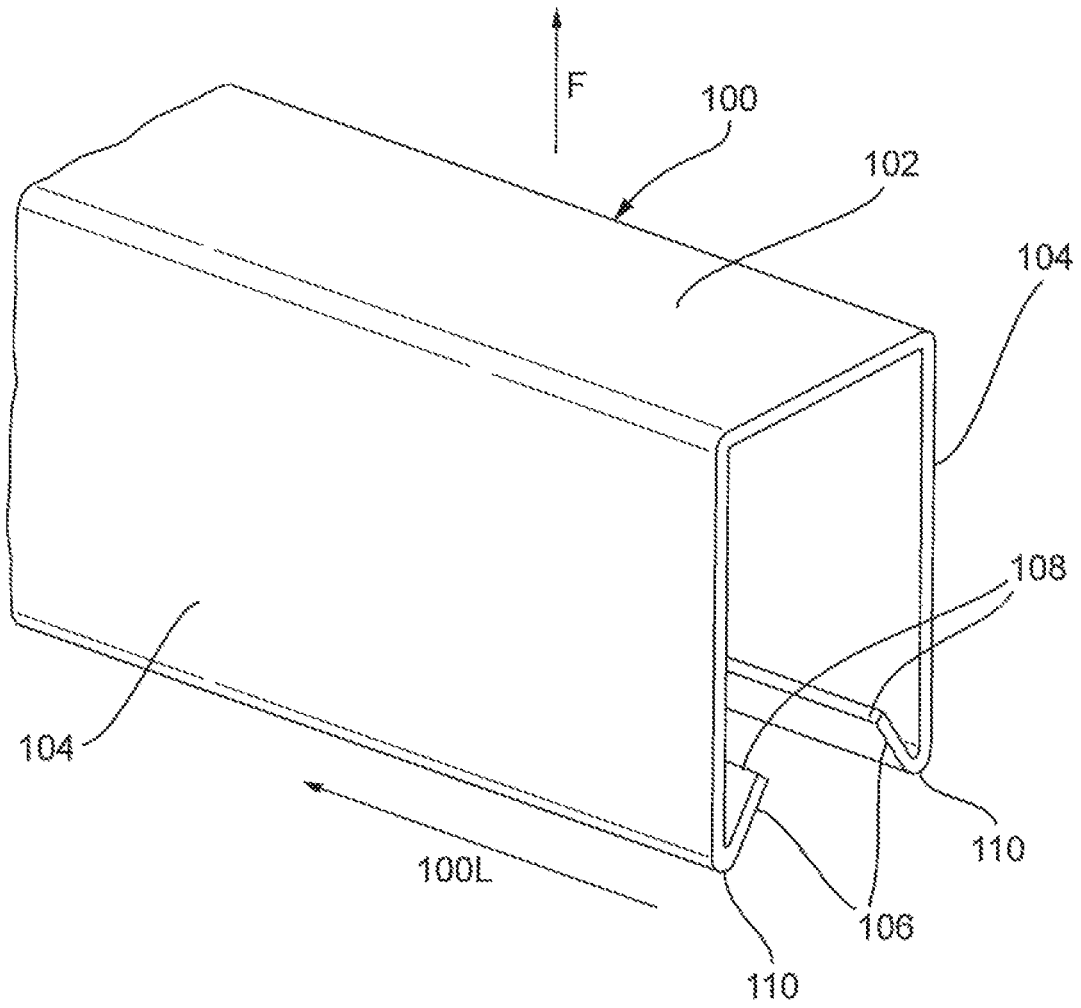
FIG. 3 illustrates a panel to be supported by the mounting system.

FIG. 2 illustrates schematically an end of a carrier 210 and FIG. 3 illustrates the profile of a panel 100 for use with the carrier 210 of FIG. 2.

As illustrated, the panel 100 has a length 100L with a longitudinal extent extending in a longitudinal direction (the length direction) and, together with the illustrated profile, forms a front wall 102 extending between two mutually opposite sidewalls 104. Each of the sidewalls includes a respective lip 106 which extends not only in the longitudinal direction of the length 100L of the panel 100, but also transversely from the respective sidewalls 104.

As illustrated, the front wall 102 faces in a first relative direction F and the lips 106 have support surfaces 108 which similarly face in the first relative direction F, but are spaced apart from the front wall 102.

The lips 106 extend generally along or parallel with the front wall 102 and thus substantially perpendicular to the respective side walls 104, but lips 106 may alternatively extend slightly towards or away from the front wall 102, in other words, such that they are at an angle with the respective side walls 104 that is smaller or greater than 90 degrees, respectively. In the illustrated arrangement, the lips 106 extend slightly towards the front wall 102, in other words inwardly of the channel section formed by the front wall 102 and the sidewalls 104.

Carriers may be provided for panels having lips which extend inwardly towards each other and inwardly of the channel formed by the front wall and sidewall. Alternatively, carriers may be provided to support panels having lips which face outwardly away from each other. The following description relates, merely by way of example, to carriers for use with panels such as that illustrated in FIG. 3 with lips 106 which extend inwardly towards each other.

With reference to FIG. 2, as discussed above, the carrier 210 may include two carrier parts 200. For ease of explanation, FIG. 2 illustrates only the features necessary for the carrier 210 to support one panel 100. As illustrated in other Figures and discussed below, these features may be repeated at intervals along the length 200L of each carrier part 200.

Each carrier part 200 includes a first edge 202 and a second edge 204 at opposite sides of the width W of the carrier part 200. The pair of carrier parts 200 are joined at their respective second edges 204. In the illustrated carrier 210, the second edges 204 of the carrier parts 200 are joined to each other by a support section 206 so that the carrier 210 has a generally U-shaped cross-sectional profile.

As illustrated, the U-shaped cross-sectional profile includes corners or bent portions where the second edges 204 meet the support section 206. However, other arrangements are possible where the support section 206 curves continuously into the carriers 200 so as to form a curved and smooth U-shaped profile.

FIG. 2 illustrates a fixing hole 208 through the support section 206 allowing the carrier 210 to be mounted relative to an architectural structure or surface, for example by means of a fastener, such as a screw.

Each carrier part 200 includes, for each respective panel 100 to be supported, a pair of engaging surfaces 212 which face inwardly of the carrier part 200 with respect to its width 200W. The engaging surfaces 212 are configured to engage with the support surfaces 108 of a corresponding respective panel 100 and, with the panel 100 mounted to the carrier part 200, will face in the direction opposite to the first relative direction F of the panel 100, thereby preventing the panel 100 from moving away from the carrier part 200 in that first relative direction F.

In the illustrated arrangement, each carrier part 200 defines a plurality of channels 214 extending to and from the first edge 202 of the carrier part 200. Each channel 214 is configured to receive a respective sidewall 104 of a panel 100 so that the respective lip 106 and its support surface 108 is positioned adjacent an engaging surface 212 within the width 200W of the carrier part 200. This is illustrated (and will be discussed in further detail below) in FIGS. 4(*a*) and (*b*).

FIG. 2 also illustrates schematically a locking strip 300 for use with one of the carrier parts 200 of the carrier 210. The locking strip has a length 300L and a width 300W and has a generally planar sheet or plate-like form.

The locking strip 300 is illustrated in FIG. 2 separated from the carrier part 200. However, in use, a locking face 302 of the locking strip 300 extending in the length 300L and 300W directions of the locking strip 300 is positioned against a carrier face 216 of the carrier part 200 extending in the length 200L and width 200W directions of the carrier part 200.

FIG. 2 does not illustrate features for mounting the locking strip 300 to the carrier part 200, but various alternatives for these features will be discussed below.

The locking strip 300 has an elongate edge 304 which extends along the length 300L of the locking strip 300. As will be described below, this is used for engaging, for example pressing against, the panels 100. The locking strip 300 also includes an edge 306 opposite to the elongate edge 304 with respect to the width 300W of the locking strip 300.

Figure 4A:
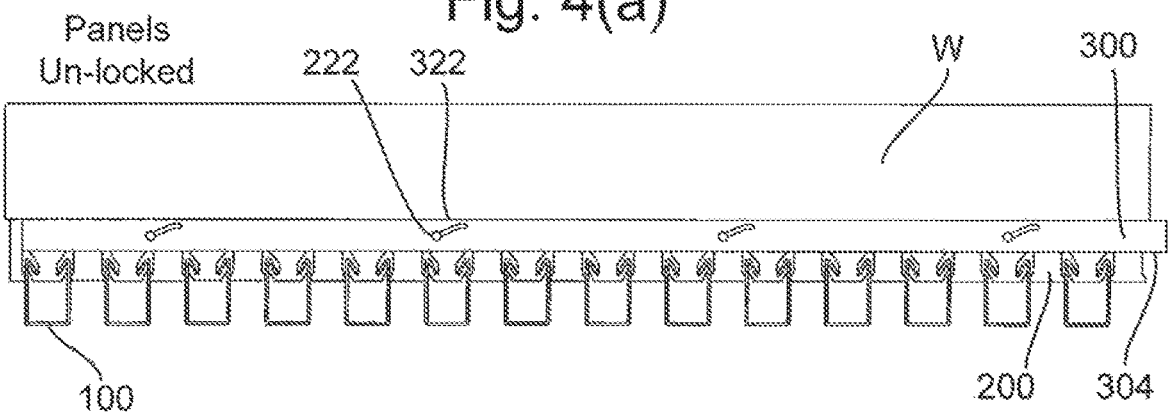
FIGS. 4(*a*) and (*b*) illustrate the mounting system from one side.
Figure 4B:
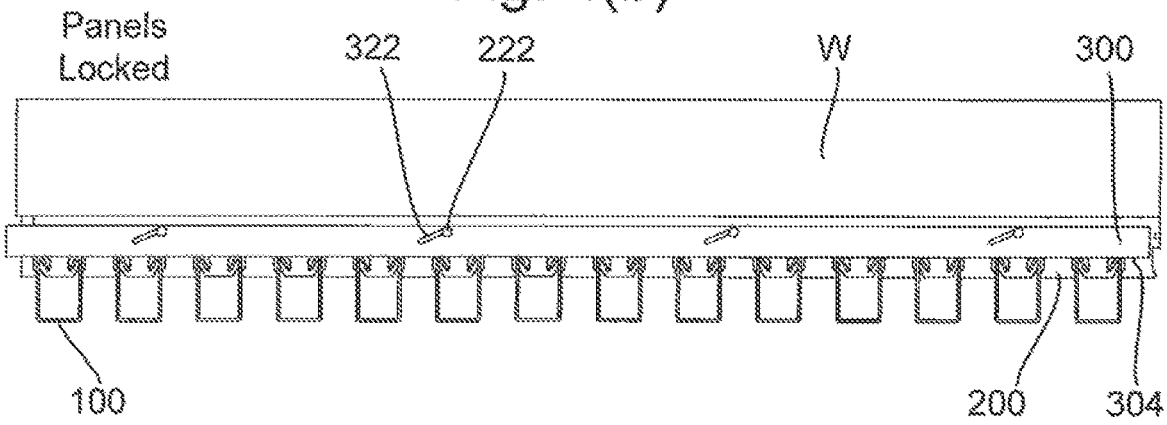

Returning to FIG. 1(*a*), it will be seen that a plurality of panels 100 are mounted on or fitted to two carriers 210, each having a pair of carrier parts 200. As illustrated, the carriers 210 are mounted horizontally, and the panels 100 are mounted on or fitted to the carrier parts 200 in a vertical orientation. In particular, the opposite sidewalls 104 extend through the channels 214 in the carrier parts 200. This is also illustrated in FIG. 4(*a*) which show a carrier part 200 in an unlocked state and is a view from above the arrangement illustrated in FIG. 1(*a*). It will be appreciated that, in this state, the panels 100 are relatively free to move in the direction of their length 100L and width with respect to the carrier part 200. With appropriate dimensioning of the channels 214 in the carrier part 200 with respect to the profile of the panels, some frictional engagement may be possible between the panels 100 and the carrier part 200. However, the purpose of the carrier system described herein is to improve any such engagement.

As illustrated in FIG. 1(*b*) and corresponding FIG. 4(*b*), the locking strip 300 has been positioned with the elongate edge 304 pressing on to the panels 100.

For the particular type of panel 100 as described above with reference to FIG. 3, the sidewalls 104 extend from the front wall 102 to edges 110 from which the lips 106 extend. in this illustrated arrangement for the panels 100, the edges 110 form the furthermost extent of the panels 100 (from the front walls 102) against which the elongate edge 304 of the locking strip 300 can engage and press.

Thus, as illustrated in FIGS. 1(*b*) and 4(*b*), with the locking strip 300 in the illustrated locked position, the elongate edge 304 of the locking strip 300 engages with and/or presses against the panels 100 (as illustrated by means of the edges 110) and, thereby, engages with and/or presses the support surfaces 108 of the lips 106 against the engaging surfaces 212 of the carrier part 200.

With the support surfaces 108 of the lips 106 engaged with and/or pressed against the engaging surfaces 212 of the carrier part 200, there is increased frictional resistance against movement of panels 100 with respect to the carrier part 200. In addition, there is also engagement and frictional resistance where the locking strip 300 engages with and/or presses against the panels 100 (in the illustrated arrangement, along the edges 110).

Thus, by means of mounting the locking strip 300 to the carrier part 200 in the locked position, it is possible to provide a more secure mounting of the panels 100 to the carrier part 200, in particular to enable mounting of the panels 100 with a slanted/angled or even vertical orientation as illustrated in FIG. 1(*b*). The mounting arrangement may be particularly effective where the panels 100 themselves are at least partly elastically or plastically deformable so that the elongate edge 304 of the locking strip 300 may press into the surface of the panels 100 (along their edges 110) and the engaging surfaces 212 may press into the support surfaces 108 of the lips 106 of the panels 100. For less flexible/elastically-deformable and/or heavier panels 100, it is also possible to provide a coating on the elongate edge 304 and/or the engaging surfaces 212, for instance a rubber material, so as to improve engagement. Alternatively, such a coating could be provided on appropriate surfaces of the panels 100.

Figure 5:
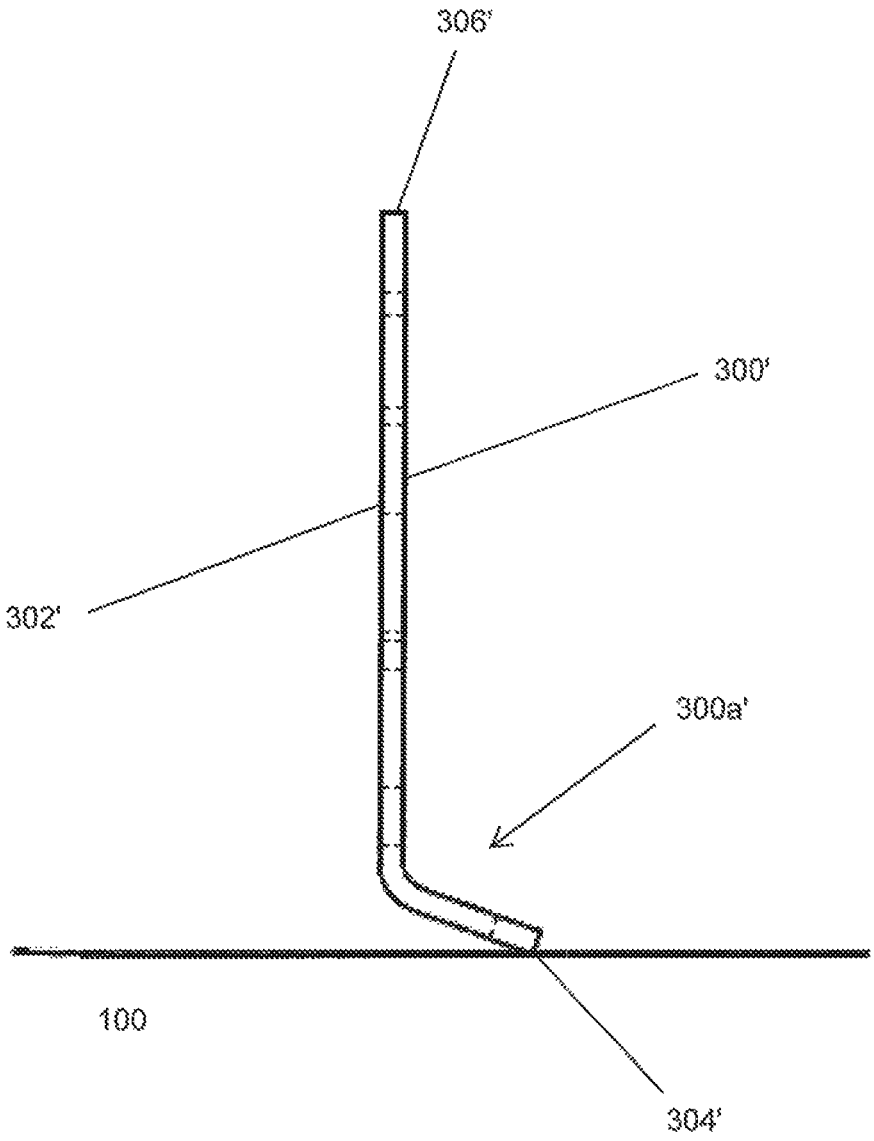
FIG. 5 illustrates schematically a cross-section of an alternative locking strip.

According to the illustrated arrangement discussed above, the locking strip 300 may have a planar form extending between the elongate edge 304 and the opposite elongate 306. However, the locking strip need not be planar and can have a curved form, for example bent, at one or more of its edges. FIG. 5 illustrates schematically the cross-section of an alternative locking strip 300'. This similarly has a locking face 302' and an elongate edge 304' which extends along the length of the locking strip 300' and is used for engaging, for example pressing against, the panels 100. Similarly, also, the locking strip 300' includes an edge 306' opposite to the elongate edge 304' with respect to the width of the locking strip'.

As is clear from FIG. 5 compared with the previously described locking strip 300, at a part 300*a*' of the locking strip 300', the locking strip curves away from, for example is bent, the locking face 302'. Any appropriate curved/bent structure may be used, hut, in the illustrated arrangement, at a position proximate to the elongate edge 304', the portion of the locking strip 300' adjacent the elongate edge 304' is curved, for example bent, away from the rest (the planar extent) of the locking strip 300'. Preferably, the portion adjacent the elongate edge 304' extends at an angle to the remainder of the locking strip 300' at an angle between 100° and 120°, preferably in the region of, substantially, 110°.

By curving/bending the edge portion of the locking strip 300', stiffness is added to the locking strip 300'. Also, the elongate edge 304' contacts panels at an acute angle. As a result, the panels may be held in place more securely. Also, an improved distribution of force may be achieved so that all of the panels are held equally and the edge of the locking strip does not cut into the panels 100.

FIGS. 6(*a*) and (*b*) illustrate schematically use of the locking strip 300' in a locked and an unlocked position.

Mounting of the locking strip 300 to the carrier part 200 in the locked position may be achieved in a number of different ways.

Figure 7:
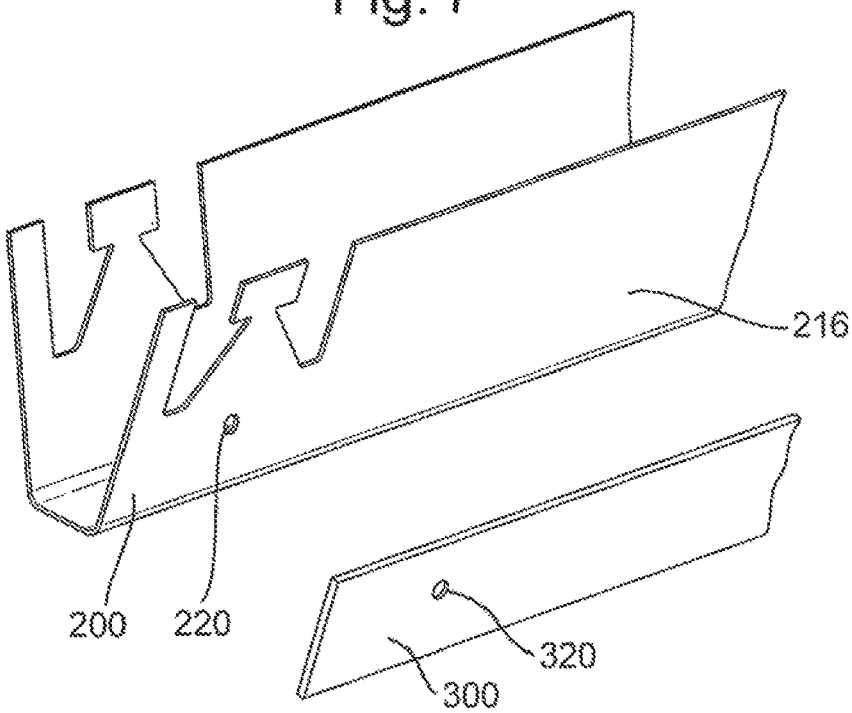
FIG. 7 illustrates schematically an alternative carrier and locking strip of the mounting system.

As illustrated schematically FIG. 7, a locking hole 220 may be provided in the support surface 216 through the thickness of the carrier 200 and a corresponding locking hole 320 may be provided in the locking face 302 of the locking strip 300 through the thickness of the locking strip 300. The two locking holes 220 and 320 are positioned such that, when they are aligned, the locking strip 300 is in the locked position for locking the mounting of the panels 100. A fastener of any appropriate type (including known screws and bolts) may be inserted through the two aligned locking holes 220 and 320 so as to secure the locking strip 300 in the locked position. In some arrangements, one of the tow locking holes may be a blind hole and the fastener extends into that blind hole.

In other arrangements, the fastener may be preassembled in a state extending through one of the two locking holes 220 and 320. Alternatively, the fastener may replace one of the locking holes 220 and 320 so as to extend in the form of a pin or protrusion to be inserted through the remaining other of the locking holes 220 and 320.

Of course, any of these locking arrangements can be provided repeatedly at intervals along the length of the carrier part 200 and locking strip 300 so as to provide additional support and strength to the mounting between the carrier part 200 and locking strip 300.

In the arrangement of FIGS. 4(*a*) and (*b*), the locking strip 300 is provided with a through hole 322 in the locking face extending through the thickness of the locking strip 300 and having an elongated extent having a path extending along the length 300L of the locking strip 300 and across the width 300W of the locking strip 300. The carrier part 200 includes a corresponding pin 222 which extends away from the carrier face through the elongate extent of the through hole 322. In this way, when the locking strip 300 is moved longitudinally in the direction of the length 200L of the carrier part 200 and the pin 222 traverses along the path of the elongate extent of the through hole 322, the locking strip 300 is moved widthwise in the direction of the width 300W of the carrier 200. In particular, referring to FIGS. 4(*a*) and (*b*), it will be seen that by moving the locking strip 300 from a first longitudinal position as illustrated to the right in FIG. 4(*a*) to a second longitudinal position as illustrated to the left in FIG. 4(*b*), the locking strip 300 is moved by the pin 222 (in the width direction of the carrier part 200) from the unlocked position away from the panels 100 to the locked position pressing against the panels 100.

Of course, as illustrated, a plurality of such through holes 322 and pins 222 may he provided at intervals along the length of the locking strip 300 and carrier 200 so as to provide additional support between the locking strips 300 and carrier 200.

Figure 8A:
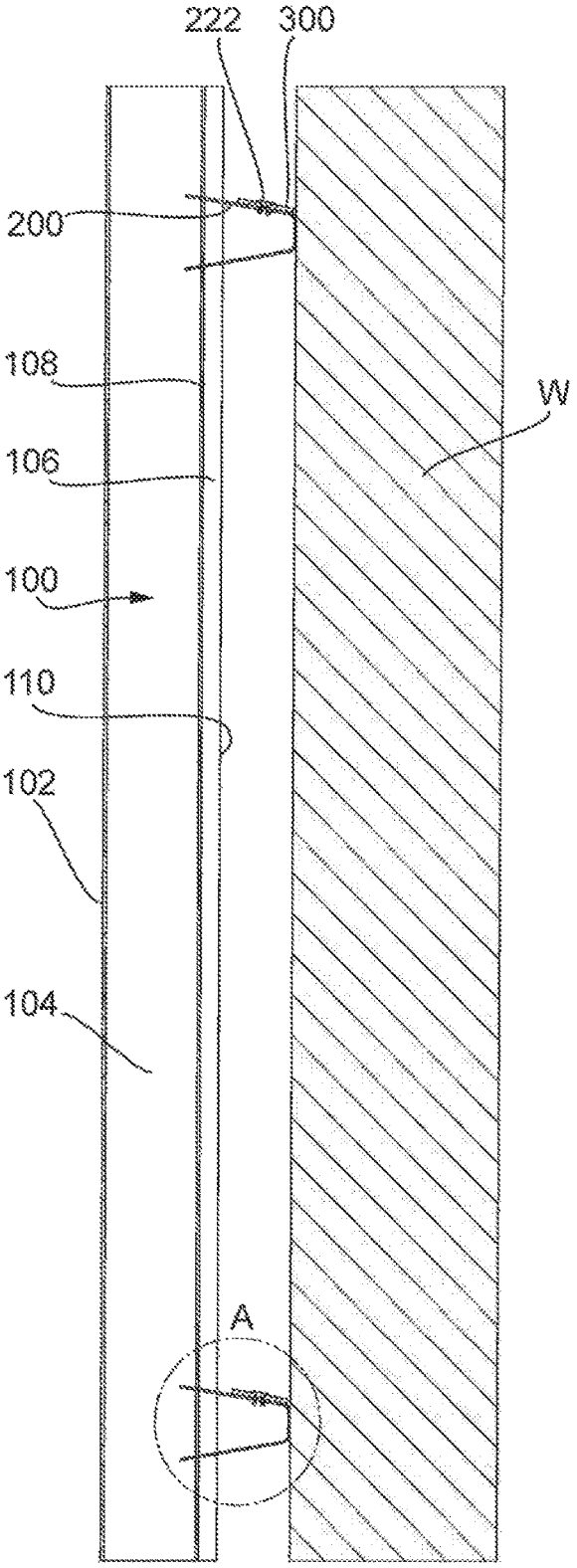
FIGS. 8(*a*) and (*b*) illustrate the mounting system from another side.
Figure 8B:
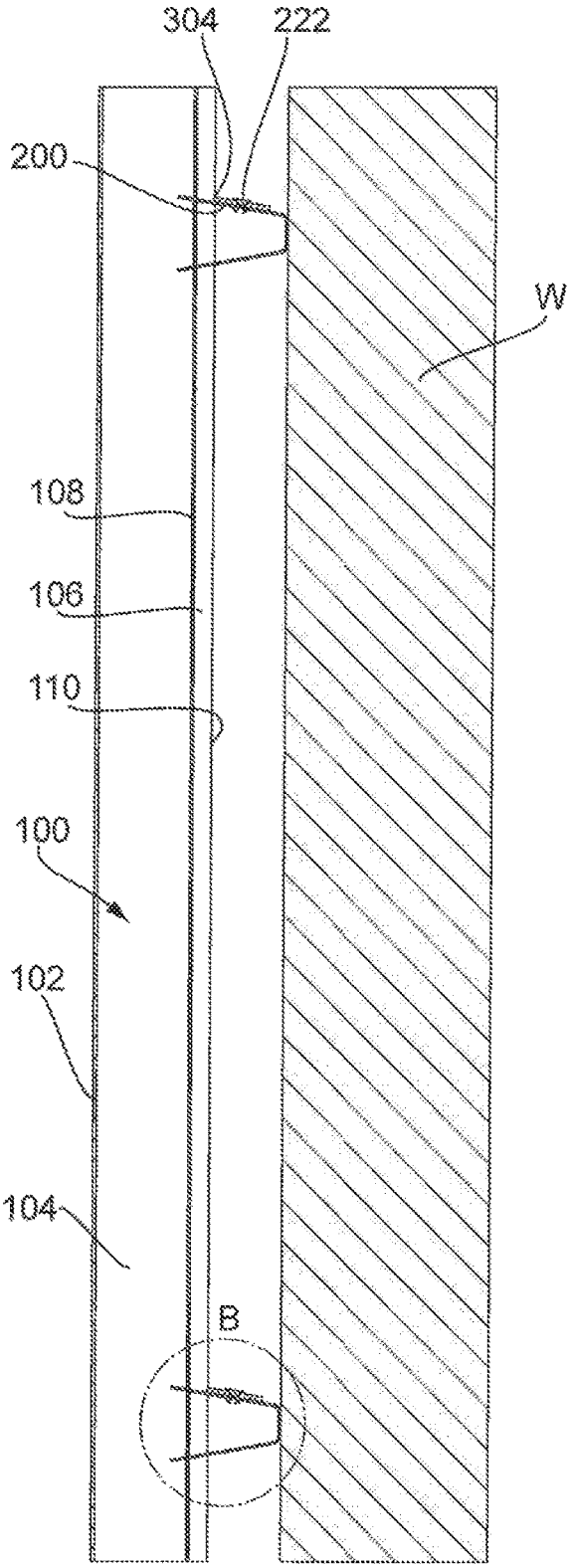
Figure 9A:
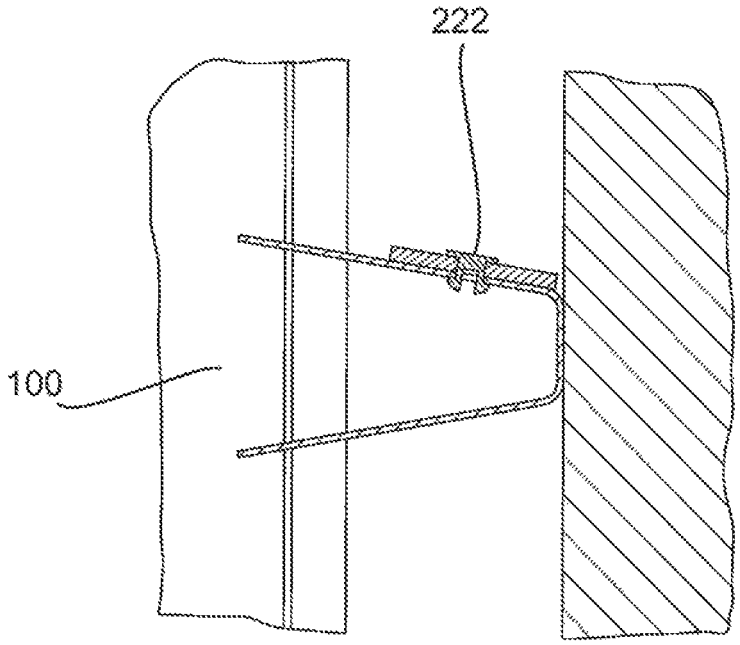
FIGS. 9(*a*) and (*b*) illustrate an enlarged view of part of FIGS. 8(*a*) and (*b*)
Figure 9B:
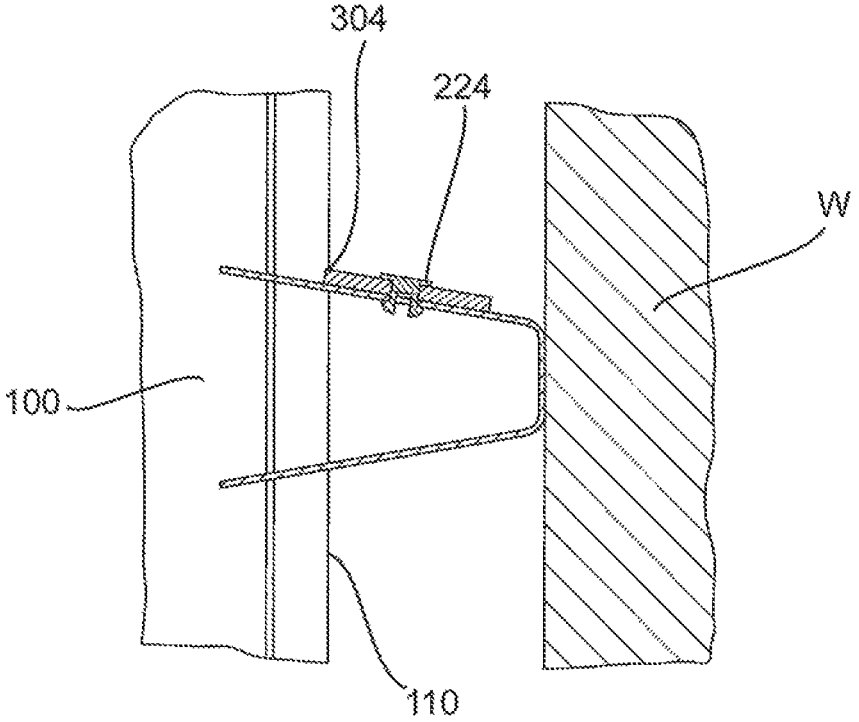

This arrangement is illustrated further in FIGS. 8(*a*) and (*b*) and FIGS. 9(*a*) and (*b*) which similarly show the arrangement respectively in the unlocked and locked states.

FIGS. 8(*a*) and (*b*) show cross-sectional views of the arrangement of FIGS. 1(*a*) and (*b*) along the length of the two carriers 210, in particular with a cross-section through one of the panels 100 and the two carriers 210.

FIG. 8(*a*) corresponds to the state of FIG. 4(*a*) with the locking strip 300 in the unlocked position spaced away from the edge 110 of the panel 100.

FIG. 8(*b*) corresponds to FIG. 4(*h*) and illustrates the locking strip 300 in the locked position with the elongate edge 304 engaged with or pressed against the edge 110 of the panel 100.

In the illustrated arrangement, only one carrier part 200 of each carrier 210 operates with a respective locking strip 300. However, both carriers 210 as illustrated have the same construction and operate in the same manner. FIGS. 9(*a*) and (*b*) show enlarged sections of FIGS. 8(*a*) and (*b*), in particular with respect to the lower of the two carriers 210. In these enlarged views, FIG. 9(*b*) illustrates that the elongate edge 304 of the locking strip 300 may press into the edge 110 of the panel 100 when the material of the panel 100 is in some way deformable.

The pin 222 may be an integral part of the carrier part 200 extending out of the carrier face 216. However, the pin 222 may also be formed, as illustrated, as a separate part mounted in a through hole in the carrier part 200. For example, as illustrated in FIGS. 9(*a*) and (*b*), the pin 222 may take the form a fitting to be pressed through the through hole 322 and through an aperture in the carrier part 200, with resilient features securing it to the other side of the carrier part 200 (opposite the carrier face 216). As illustrated, the pin 222 may also be provided a flange 224 extending over the surface of the locking strip 300 (opposite to the locking face 302). This flange 224 acts to hold the locking strip 300 against the carrier part 200 with the locking face 302 against the carrier face 216.

In practice, the carrier part 200 may be formed with a plurality of through holes in an array along the length of the carrier part 200 in the carrier face 216. Such holes may be used for the arrangement as described by attaching/mounting pins at predetermined intervals using those holes and providing a locking strip 300 with the elongate through hole 322 at appropriate intervals for use with the pins. In this way, it may be possible to make use of a carrier previously used only for suspending panels from a ceiling and modify that carrier to include the pins for mounting the locking strip 300.

From the description above, it will be appreciated that the mounting arrangement between the locking strip 300 and carrier part 200 could be reversed with one or more pins provided extending from the locking face 302 of the locking strip 300 and appropriate elongate through-holes provided in the carrier face 216 of the carrier part 200.

The locking strip discussed above is illustrated with ends (not discussed) that are substantially perpendicular to the longitudinal extent of the elongate edges. In other words, the ends extend substantially in the direction of the width 300W. This is not essential.

Figure 10B:
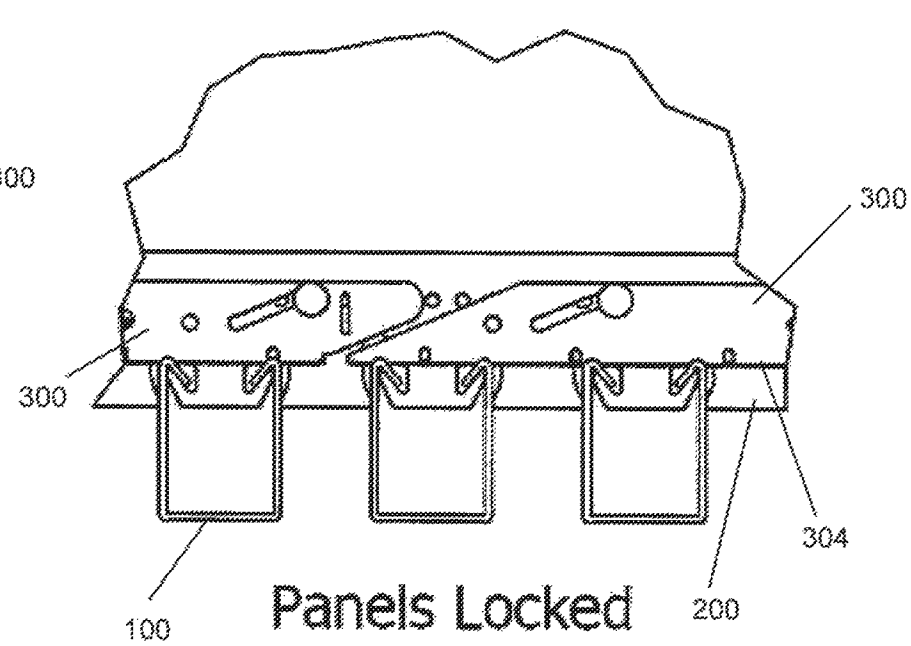
FIGS. 10(*a*) and (*b*) illustrate slanted ends of a locking strip.
Figure 10A:
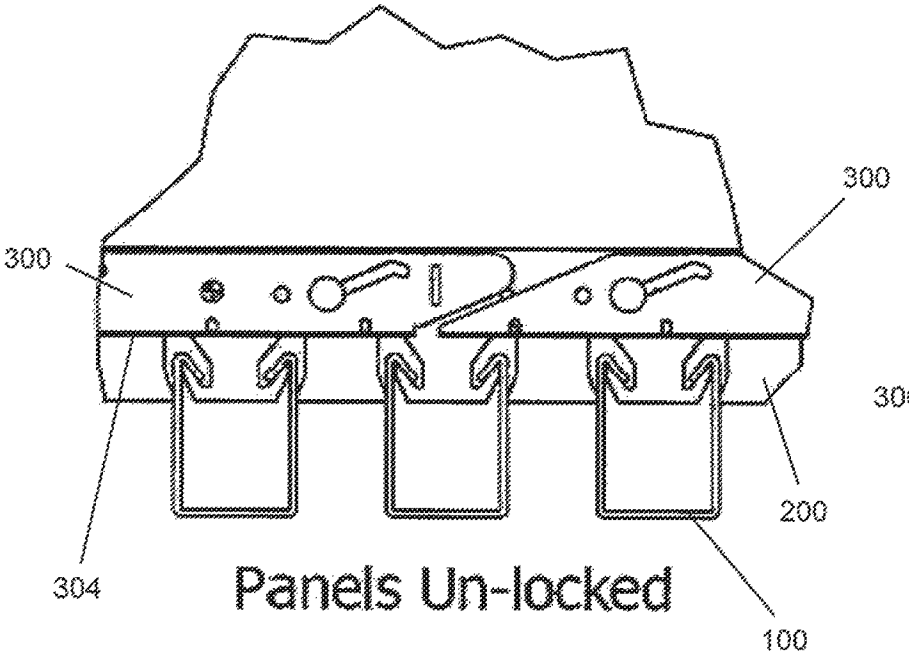

For example as illustrated in FIGS. 10(*a*), 10(*b*) and 11(*a*), the respective ends may take the form of side edges 350A and 350B that are slanted with respect to the elongate edges 304 and 306. This allows two locking strips 300 to be mounted adjacent to one another end-to-end. In particular, with arrangements where the path of the elongate through hole is angled/slanted relative to the elongate edges 304, 306, it becomes possible for an individual respective locking strip to be moved between its locked and unlocked positions whilst not interfering e adjacent locking strip. For best operation, the slanted angle of the side edges 350A, 350B corresponds to or is the same as the angle of the path of the elongate through holes 322. However, a similar effect can be achieved where the angles of the slants of the side edges 350A, 350B are similar to the angle of the path of the elongate through holes 322 and a corresponding gap is provided between the adjacent ends of respective locking strips to take account of any differences in the angles. In advantageous arrangements, the angle is between 18 and 28°, more preferably 21 to 24° and, in one particular example, approximately 23°, for example 23.3°.

Figure 11A:
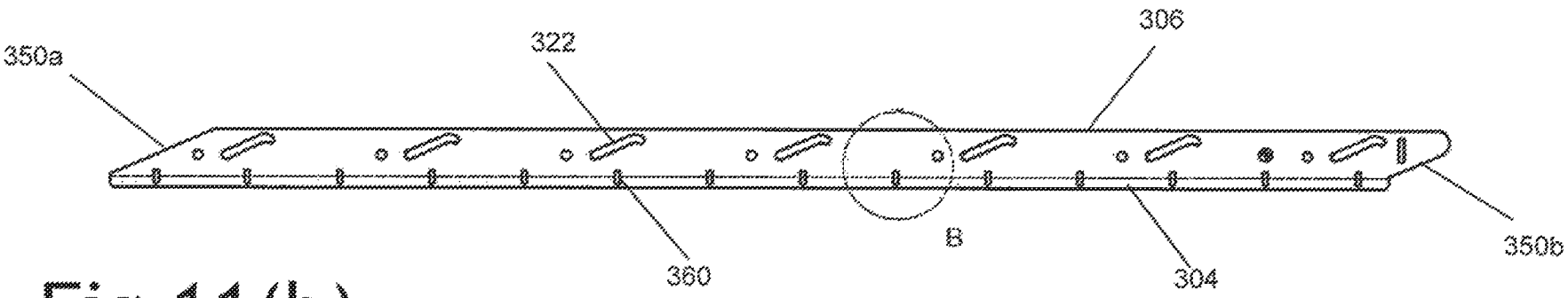
FIGS. 11(*a*) and (*b*) illustrate a locking strip with slots for adjustment.
Figure 11B:
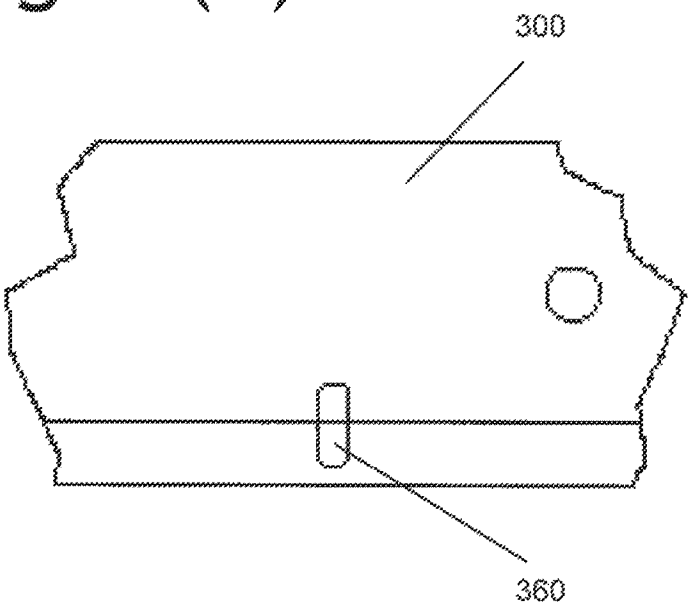

The locking strip illustrated in FIGS. 10(*a*), 10(*b*) and 11(*a*) also includes a feature of providing an array of spaced slots along the elongate extent of the locking strip 300. The enlarged portion of "B" of FIG. 11(*a*) is illustrated in FIG. 11(*b*) to illustrate more clearly one of the slots 360.

The slots 360 are configured to receive a tool, such as a conventional screwdriver. They are provided so as to allow this tool, such as the screwdriver, to engage in one of the slots 360 and allow a user to conveniently move and adjust the position of the locking strip 300. It will be appreciated that such an array of slots 360 can be provided, as appropriate, with any of the features of an array of locking strips as discussed.

Figure 12:
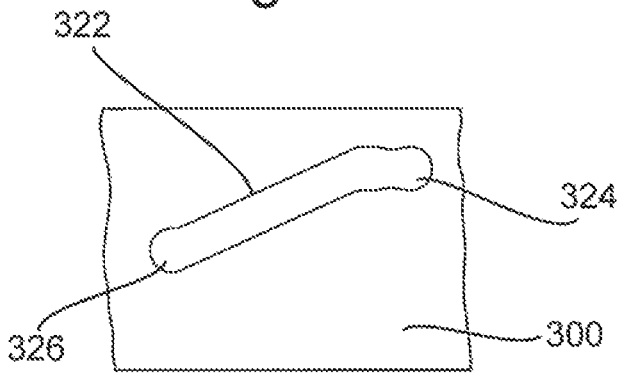
FIGS. 12, 13, 14 and 15 illustrate alternative path shapes.

FIG. 12 illustrates an enlarged view of the through-hole 322.

As illustrated, in one embodiment, the path of the through hole 322 has a first end portion 324 which extends parallel with the length 300L of the locking strip 300. This first end portion 324 receives pin 222 when the locking strip 300 is in the locked position. Hence, when the panel 100 exerts a force on the locking strip 300 opposing the pressure from the locking strip 300, an internal wall of the first end portion 324 presses on the pin 222 only in the direction of the width 300W of the locking strip 300. In other words, the locking strip 300 remains in the locking position and there is no tendency for the pin 222 to travel along the path allowing the locking strip 300 to return to the unlocked position.

As illustrated, a second end portion 326 opposite first end portion 324 of the path of the through hole 322 also extends parallel with the length 300L of the locking strip 300. In the illustrated arrangement, this length is merely sufficient to receive the full extent of the pin 222, because, in the unlocked position in which the pin 222 is in the opposite second end portion 326, there is no particular force acting on the locking strip 300.

In the arrangement of FIG. 12, the path of the through hole 322 extends diagonally across the width 300W of the locking strip 300 between the first end portion 324 and the opposite second end portion 326. Thus, as described above, when the locking strip 300 is moved longitudinally in the direction of the length 200L of the carrier part 200, it is guided by the diagonal path of the through hole 322 so as to move widthwise in the direction of the width 200W of the carrier part 200 towards the panels and into the locked position.

Figure 13:
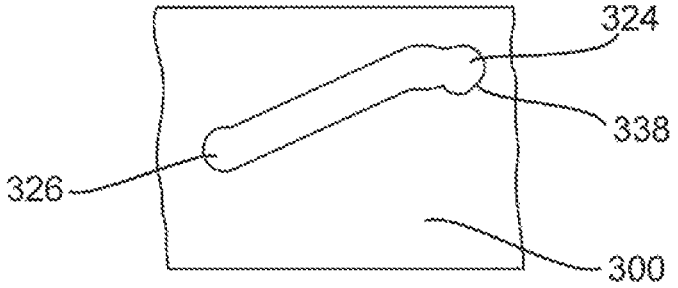

FIG. 13 illustrates a variation to the path of FIG. 12 in which the first end portion 324 includes a small recess extending towards the opposite edge 306 of the locking strip 300. This slight recess 328 will, of course, allow the locking strip 300 to move slightly back towards the unlocked position, lessening the pressure exerted by the elongate edge 304 on the panels 100, However, the pin 222 will be retained more securely in this recess 328 so as to prevent the locking strip 300 moving in the direction of the length 200L of the carrier part 200. In other words, the locking strip 300 is more securely held from slipping from the locked position to the unlocked position.

Figure 14:
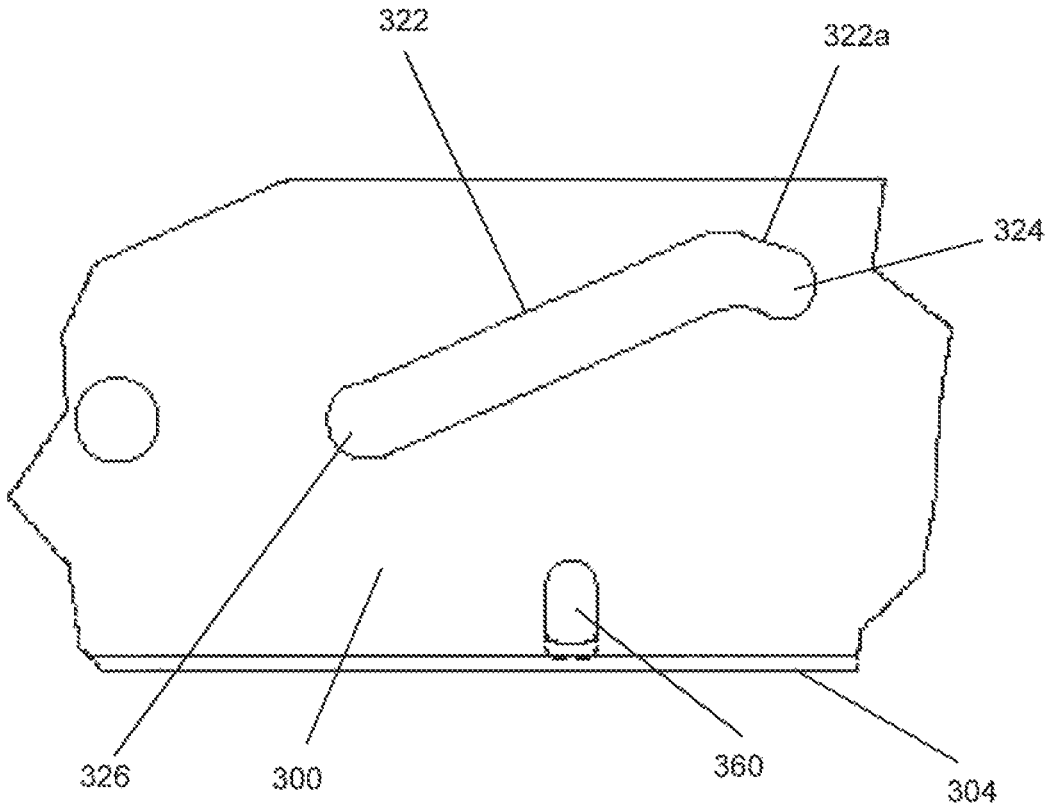

FIG. 14 illustrates another variation to the path of FIG. 12 in which the through hole 322 extends first diagonally across the width 300W of the locking strip 300 in the manner described above, but, then, along a section 322A towards/proximate the first end portion 324 extends diagonally in the opposite direction partially across the width 300W of the locking strip. In other words, the through hole 322 has a path which changes direction and extends at a slight angle towards the elongate edge 304 that is for contacting a panel 100.

With this shape, at the end of the sliding movement of the locking strip, the elongate edge 304 of the locking strip 300 presses into the edge of the panel 100, temporarily deforming it before the locking strip 300 moves past the end formed by the angled shape of the path of the through hole 322. It is then locked into the seat formed by the first end portion 324. This arrangement may find particular advantageous application when used with more flexible panels, such a flexible felt panels. In particular, the elongate edge 304 of the locking strip may press into the resilient edge of the panel, temporarily deforming it. The geometry may ensure that the locking strip 300 stays in its locked position.

Figure 15:
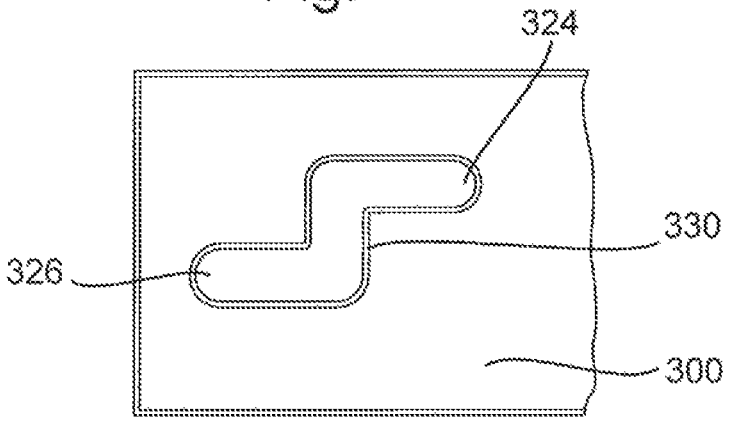

FIG. 15 illustrates an alternative path for the elongate extent of the through hole 322. In particular, according to this path, between the first end portion 324 and the opposite second end portion 326, the path includes a section 330 which extends only in the direction of the width 300W of the locking strip 300. With this arrangement, during installation, the locking strip 300 is moved by the installer in the direction of the width 200W of the carrier part 200 so as to move the elongate edge 304 of the locking strip 300 towards the panels 100. The locking strip 300 may then be moved in the direction of the length 200L of the carrier part 200 so that the pin moves into the first end portion 324 and the locking strip 300 is secured in the locked position.

Figure 16:
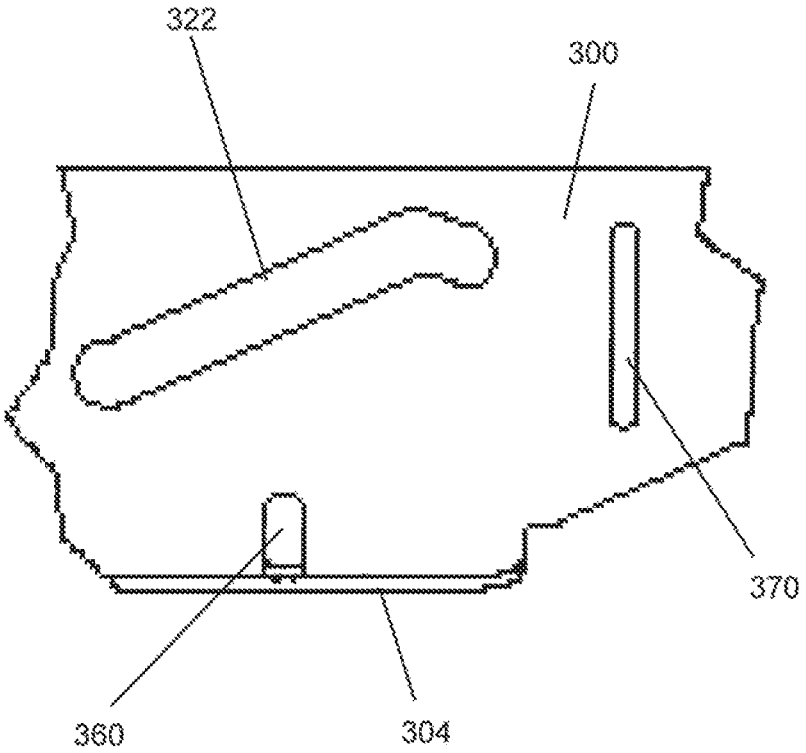
FIG. 16 illustrates a locking strip with a bending feature at one end.

FIG. 16 illustrates one end of a locking strip 300 which is provided with a slot 370 extending through the thickness of the locking strip 300 and across the width 300W of the locking strip 300. In effect, the slot 370 weakens the locking strip 300 with respect to its width and allows a user easily to bend the locking strip 300 about an axis extending with the elongate extent of the slot 370. The user may thus bend an end portion of the locking strip 300 with respect to its length so as to form a flange at that end of the locking strip 300. The flange provides a convenient part for a user to grip the locking strip 300 to move it between locked and unlocked positions. In use, a user will typically bend the end section by approximately 90°.

It will be appreciated that other, different features could alternatively be provided across the width 300W of the locking strip 300. Such a bending feature could be, instead of the slot 370 as illustrated, an array of individual holes or a reduction in the thickness of the locking strip 300 along a particular line. The bending feature preferably extends across the width 300W of the locking strip 300 substantially perpendicular to the edges 304, 306. However, a bending feature which extends across the width 300W at a different angle can still be used by the user to form an appropriate flange. Angles between 45 and 135° may be used and more preferably between 75 and 105°.

Figure 17A:
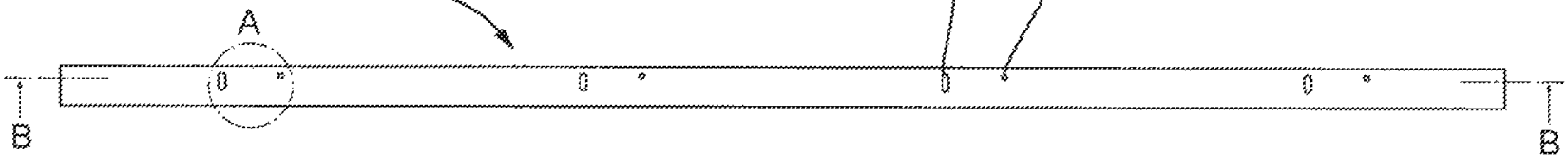
FIGS. 17(*a*) and (*b*) illustrate an alternative locking strip.
Figure 17B:
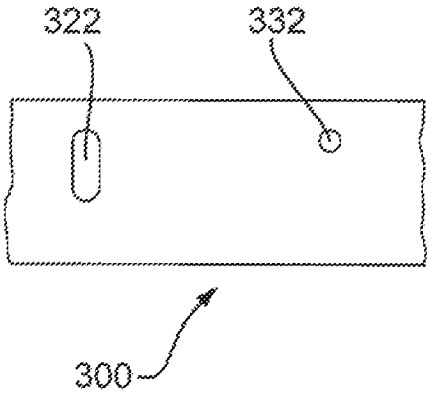

FIG. 17(*a*) illustrates an alternative arrangement for the locking strip 300 where the through hole 322 does not include the first end portion 324 for securing the locking strip 300 in the locked position.

One of the through holes 322 is illustrated in an enlarged view in FIG. 17(*b*), together with an associated fixing hole 332 for receiving a fastener to secure the locking strip 300 in the locked position.

Although the through hole 322 could be elongated in a path extending diagonally across the width of the locking strip 300, in the illustrated arrangement, the through hole 322 extends only in the direction of the width 300W of the locking strip 300. When the locking strip 300 has been moved to the locked position, the fixing hole 322 is aligned with a through hole in the carrier part 200 and may be fixed from further movement by inserting a fastener in a similar manner to that described above with reference to FIG. 5.

Figure 18:
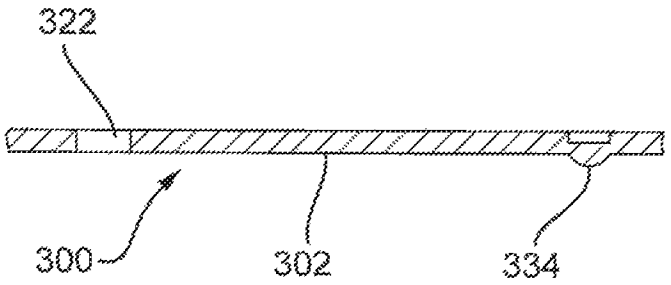
FIG. 18 illustrates an alternative locking strip.

Alternatively, as illustrated in FIG. 18, in place of the fixing hole 332, the locking strip 300 may be provided with a protrusion 334 on the locking face 302 of the locking strip 300. This protrusion 334 is configured to align with a corresponding recess or aperture in the carrier face 216 of the carrier part 200 when the locking strip 300 is in the locked position. In this way, the locking strip 300 may be held relative to the carrier part 200 in the locked position. Such a protrusion 334 may similarly be used on the locking strip 300 having through holes 322 which extend diagonally across the width of the locking strip 300.

It will be appreciated that other shapes may be provided for the path of the through hole 322 and other means provided for securing the locking strip from moving from its locked position.

As mentioned previously above, it will be appreciated that the features described as part of the locking strip 300 and the features described as being part of the carrier part 200 may be replaced with each other, ie interchanged, for example with the through hole being provided in the carrier part 200 for guiding a pin on the locking strip 300 and the protrusion being provided on the carrier face for engaging in a recess or aperture in the locking strip 300 and for securing the locking strip in the locked position.

The mounting arrangements described above are configured to provide relative linear motion between the locking strip 300 and the carrier part 200 when moving between unlocked and locked positions. Alternatively, mounting arrangements may provide for relative rotational movement.

Figure 19A:
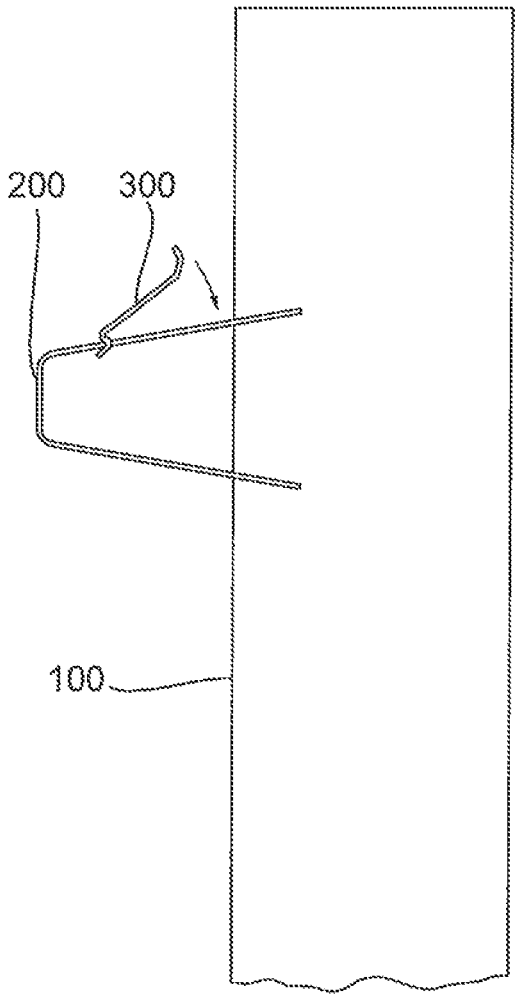
FIGS. 19(*a*) and (*b*) illustrate an alternative mounting arrangement for a locking strip.
Figure 19B:
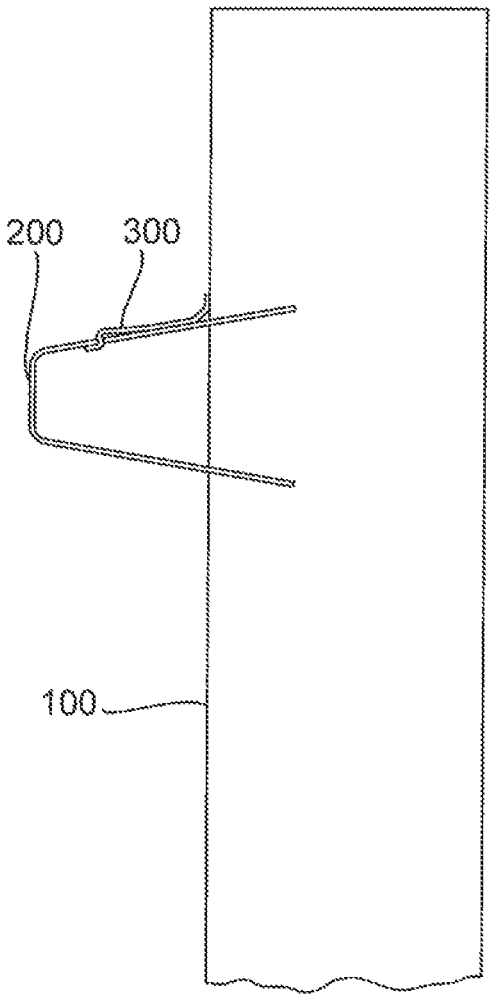

As illustrated in FIGS. 19(*a*) and (*b*), the locking strip 300 may pivot relative to the carrier part 200 about a longitudinal axis, for example extending parallel with the length 300L of the locking strip 300, the length 200L of the locking part 200 and the elongate edge 304.

As illustrated, the locking strip 300 may be rotated about the pivot from an unlocked position as illustrated in FIG. 19(*a*) to a locked position as illustrated in FIG. 13(*b*).

To improve contact between the locking strip 300 and the panels 100, an extension or flange may be provided along the elongate edge 304.

Although a hinge using a rotational pin may be used, it is also possible for the opposite edge 306 of the locking strip 300 to engage with a portion of the carrier part 200 so as to allow relative rotation whilst being secured in the locked position. For example, one or both of the locking strip 300 and carrier part 200 may include bent portions and recesses which fit into one another allowing the locking strip 300 to rotate to the locked position and then be secured in the locked position. In one arrangement, extensions from the opposite edge 306 of the locking strip 300 may be configured to extend through apertures in the carrier part 200. Spring clips may be provided for fastening the elongate edge 304 (or an extension thereof) to the carrier part 200 with the locking face 302 against the carrier face 216 in the locked position. For example, such spring clips may be provided at portions between adjacent panels, In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure. Connection references (e.g., attached, coupled, connected, and joined) are to he construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc. are not intended to connote importance or priority, but are used to distinguish one feature from another.

It is to be understood by one of ordinary skill in the art that the present discussion is a description of exemplary embodiments only, and is not intended as limiting the broader aspects of the present disclosure.

In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

The invention claimed is:

1. A system for mounting a plurality of panels, each panel having a longitudinal extent and a cross-sectional profile that together form a front wall extending between two mutually opposite side walls, the front wall facing in a first relative direction and the side walls including longitudinally and transversely extending respective lips which have support surfaces facing in the first relative direction and are spaced apart from the front wall, the system comprising:

a carrier part having a length and a width and configured to receive and support the panels at intervals along said length, the carrier part having a carrier face extending in the directions of said length and said width, and having, within the extent of said width, for each respective panel, a pair of engaging surfaces facing in an engaging direction directed inwardly with respect to said width and opposite to the first relative direction of a mounted panel, the engaging surface being for engaging with said support surfaces of the lips of a respective panel; and a locking strip having a length extending in a lengthwise direction of the locking strip and a width extending in a widthwise direction of the locking strip perpendicular to the lengthwise direction, the locking strip having a locking face extending in the lengthwise and widthwise directions of said length and said width of the locking strip, and having an elongate edge extending along the lengthwise direction of the locking strip;

wherein:

the carrier part and the locking strip are configured to be mounted to each other with the locking face towards the carrier face and to couple the locking strip relative to the carrier part in a locked position with the elongate edge engaging with the panels so as to engage the support surfaces of the lips of the panels with the respective engaging surfaces; and the locking strip is configured to move at least partially relative to the carrier strip in both the lengthwise and widthwise directions of the locking strip to move the locking strip between an unlocked position and the locked position.

2. A system according to claim 1, each panel having pairs of said lips extending inwardly towards each other.

3. A system according to claim 1, wherein the carrier part includes first and second edges extending along the length of the carrier part at opposite sides of the width of the carrier part and defines a plurality of channels extending inwardly from the first edge, the plurality of channels being configured to receive the side walls of the panels and defining the respective pairs of engaging surfaces for the respective panels.

4. A system according to claim 3, further comprising a carrier having two of said carrier parts positioned parallel to each other, the two carrier parts having corresponding respective pairs of engaging surfaces for engaging with the same respective lips of respective panels at different positions along the longitudinal extent of the respective panels; and wherein the two carrier parts may join with each other at the respective second edges to form a channel, such as a V-shaped or U-shaped profile.

5. A system according to claim 1, further comprising at least one fastener for coupling the locking strip to the carrier part in the locked position.

6. A system according to claim 1, further comprising a mounting arrangement configured to mount the locking strip to the carrier part and to provide movement of the locking strip relative to the carrier part between the unlocked position and the locked position.

7. A system according to claim 6, wherein the mounting arrangement is configured to permit movement of the locking strip in both the lengthwise and widthwise directions of the locking strip.

8. A system according to claim 6, wherein the mounting arrangement includes, on one of the carrier part or the locking strip, a pin, and, through the other of the carrier part or the locking strip, a through hole having an elongate extent extending across the width and the length of said other of the carrier part or the locking strip.

9. A system according to claim 8, wherein the elongate extent has a path along the length and across the width in a first direction of said other of the carrier part or the locking strip such that movement of the locking strip relative to the carrier part in the direction of the length of the carrier part causes, by the pin following the elongate path, movement of the locking strip relative to the carrier part in both the lengthwise and widthwise direction of the locking strip between the unlocked and locked positions.

10. A system according to claim 9, wherein the path has a first end portion for receiving the pin when the locking strip is in the locked position, and wherein the path of the first end portion extends one of: parallel with the length of said other of the carrier part or the locking strip or along the length and partially across the width in a second direction, opposite to said first direction, of said other of the carrier part or the locking strip.

11. A system according to claim 10, wherein the path has a second end portion for receiving the pin when the locking strip is in the unlocked position, and wherein the path extends parallel with the length of said other of the carrier part or the locking strip.

12. A system according to claim 11, wherein, between the end portion and the opposite end portion, the path extends one of:

only in the direction of the width of the other of the carder part or the locking strip; or diagonally across the width of the other of the carrier part or the locking strip.

13. A system for mounting a plurality of panels, each panel having a longitudinal extent and a cross-sectional profile that together form a front wall extending between two mutually opposite side walls, the front wall facing in a first relative direction and the side walls including longitudinally and transversely extending respective lips which have support surfaces facing in the first relative direction and are spaced apart from the front wall, the system comprising:

a carrier part having a length and a width and configured to receive and support the panels at intervals along said length, the carrier part having a carrier face extending in the directions of said length and said width, and having, within the extend of said width, for each respective panel, a pair of engaging surfaces facing in an engaging direction directed inwardly with respect to said width and opposite to the first relative direction of a mounted panel, the engaging surface being for engaging with said support surfaces of the lips of a respective panel; and a locking strip having a length and a width, having a locking face extending in the directions of said length and said width of the locking strip, and having an elongate edge extending along said length of the locking strip; and a mounting arrangement configured to mount the locking strip to the carrier part and to provide movement of the locking strip relative to the carrier part between an unlocked position and a locked position, the mounting arrangement including, on one of the carrier part or the locking strip, a pin, and, through the other of the carrier part or the locking strip, a through hole having an elongate extent extending at least across the width of said other of the carrier part or the locking strip;

wherein:

the carrier part and the locking strip are configured to be mounted to each other with the locking face towards the carrier face and to couple the locking strip relative to the carrier part in the locked position with the elongate edge engaging with the panels so as to engage the support surfaces of the lips of the panels with the respective engaging surfaces;

elongate extent has a path along the length and across the width in a first direction of said other of the carrier part or the locking strip such that movement of the locking strip relative to the carrier part in the direction of the length of the carrier part causes, by the pin following the elongate path, movement of the locking strip relative to the carrier part in the direction of the width of the carrier part between the unlocked and locked positions.

14. A system according to claim 13, wherein the path has a first end portion for receiving he pin when the locking strip is in the locked position, and wherein the path of the first end portion extends one of: parallel with the length of said other of the carrier part and the locking strip and along the length and partially across the width in a second direction, opposite to said first direction, of said other of the carrier part and the locking strip.

15. A system according to claim 14, wherein the path has a second end portion for receiving the pin when the locking strip is in the unlocked position, and wherein the path extends parallel with the length of said other of the carrier part and the locking strip.

16. A system according to claim 15, wherein, between the end portion and the opposite end portion, the path extends one of:

only in the direction of the width of the other of the carrier part and the locking strip; and diagonally across the width of the other of the carrier part and the locking strip.

17. A system according to claim 13, wherein the carrier part includes first and second edges extending along the length of the carrier part at opposite sides of the width of the carrier part and defines a plurality of channels extending inwardly from the first edge, the plurality of channels being configured to receive the side walls of the panels and defining the respective pairs of engaging surfaces for the respective panels.

18. A system according to claim 17, wherein the pivot includes a bent portion in one of the locking strip and the carrier part protruding through a recess in the other of the locking strip and the carrier part.

19. A system according to claim 13, wherein the carrier part includes first and second edges extending along the length of the carrier part at opposite sides of the width of the carrier part and defines a plurality of channels extending inwardly from the first edge, the plurality of channels being configured to receive the side walls of the panels and defining the respective pairs of engaging surfaces for the respective panels.

20. A system for mounting a plurality of panels, each panel having a longitudinal extent and a cross-sectional profile that together form a front wall extending between two mutually opposite side walls, the front wall facing in a first relative direction and the side walls including longitudinally and transversely extending respective lips which have support surfaces facing in the first relative direction and are spaced apart fro the front wall, the system comprising:

a carrier part having a length and a width and configured to receive and support the panels at intervals along said length, the carrier part having a carrier face extending in the directions of said length and said width, and having, within the extent of said width, for each respective panel, a pair of engaging surfaces facing in an engaging direction directed inwardly with respect to said width and opposite to the first relative direction of a mounted panel, the engaging surface being for engaging with said support surfaces of the lips of a respective panel; and a locking strip having a length and a width, having a locking face extending in the directions of said length and said width of the locking strip, and having an elongate edge extending along said length of the locking strip; and a mounting arrangement configured to mount the locking strip to the carrier part and to provide movement of the locking strip relative to the carrier part between an unlocked position and a locked position;

wherein:

the carrier part and the locking strip are configured to be mounted to each other with the locking face towards the carrier face and to couple the locking strip relative to the carrier part in the locked position with the elongate edge engaging with the panels so as to engage the support surfaces of the lips of the panels with the respective engaging surfaces; and at an edge of the locking strip opposite to said elongate edge, the mounting arrangement provides a pivot between the locking strip and the carrier part, the pivot having a rotational axis parallel with the elongate edge and allowing the locking strip to pivot about said pivot between the unlocked position and the locked position.

* * * * *